United States Patent [19]

Dunlop

[11] 4,089,363

[45] May 16, 1978

[54] METHOD OF MANUFACTURING SHELL CORES AND MOLDS

[75] Inventor: Andrew P. Dunlop, Riverside, Ill.

[73] Assignee: The Quaker Oats Company, Chicago, Ill.

[21] Appl. No.: 754,360

[22] Filed: Dec. 27, 1976

[51] Int. Cl.[2] ..... B22C 9/12

[52] U.S. Cl. ..... 164/16; 164/200

[58] Field of Search ..... 164/16, 12, 43, 23, 164/200

[56] References Cited

U.S. PATENT DOCUMENTS

| | | | |
|---|---|---|---|
| 2,874,428 | 2/1959 | Bonney, Jr. | 164/16 X |
| 3,006,046 | 10/1961 | Shephard, Jr. et al. | 164/16 |
| 3,008,205 | 11/1961 | Blaies, Jr. | 164/16 |
| 3,100,919 | 8/1963 | Vayda | 164/16 X |
| 3,145,438 | 8/1964 | Kottke et al. | 164/16 |
| 3,428,110 | 2/1969 | Walker et al. | 164/16 |
| 3,556,195 | 1/1971 | Lund | 164/16 |
| 3,639,654 | 2/1972 | Robins | 164/16 X |

*Primary Examiner*—Robert L. Spicer, Jr.
*Attorney, Agent, or Firm*—Joseph P. O'Halloran

[57] ABSTRACT

The method is a "cold box" method in which a porous or thoroughly vented pattern is used. The pattern is preferably completely filled with sand, packed tightly, and then gassed through the pattern with a binder-curing gas catalyst. Control of depth of penetration of the gas catalyst is achieved by control of pre- and post-gassing pressures. The residual pre-gassing interstitial inert gas (usually air) is utilized as an internal cushion which limits penetration of the advancing catalyst gas.

10 Claims, 1 Drawing Figure

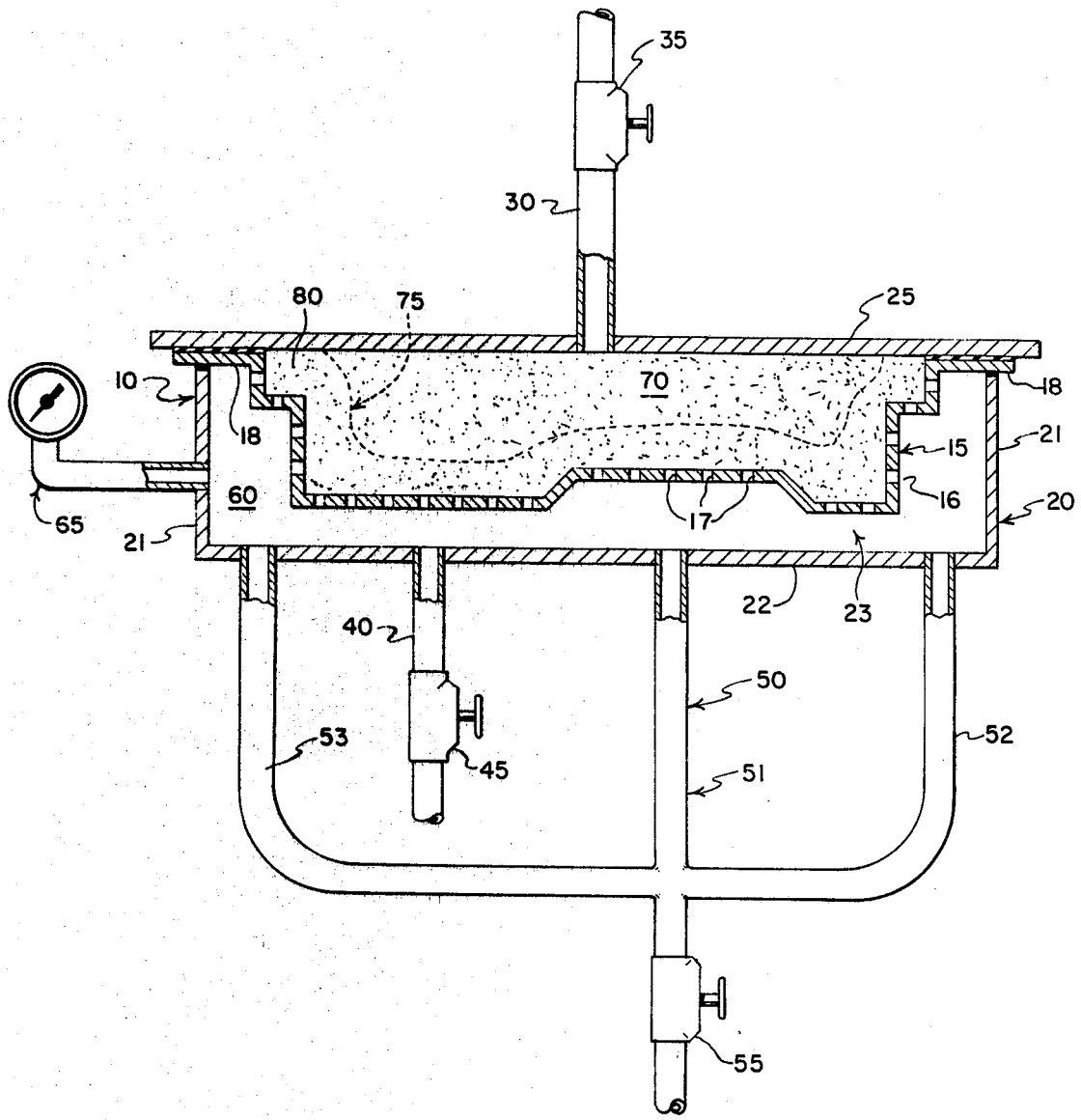
35
30
80
75
25
10
70
18
18
21
15
60
16
20
65
21
17
22
23
40
50
53
45
52
51
55

METHOD OF MANUFACTURING SHELL CORES AND MOLDS

BACKGROUND OF THE INVENTION

One of the earliest known procedures for producing shell molds is the Kroning process, which involved the use of a sand having coated thereon a dry solid resin, usually a phenol-formaldehyde novolac resin, catalyzed with hexamethylene tetramine. This catalyzed resin binder is stable under ordinary atmospheric ambient conditions but is catalytically polymerized, that is, cured, at elevated temperatures. In the practice of the Kroning method, the dry coated catalyzed sand, usually AFS 80–90 grain fineness, for example, is packed into a metal pattern capable of being heated. The pattern is pre-heated to a sufficiently high temperature, e.g. 450°–500° F. to achieve the polymerization of the binder on the sand disposed thereagainst. Typically only a thin layer of the sand mixture is cured.

One of the main advantages of manufacturing shell cores and molds is the fact that a relatively thin shaping surface is fabricated, and that the shell core and mold manufacturing procedure does not require the hardening of a quantity of sand which would otherwise have filled the entire region within the shell core or mold. Typically in the traditional "dry" hot box method the pattern is then inverted and uncured sand-binder is dumped and separated from the relatively thin "shell" of cured sand-binder, and the dumped uncured sand-binder portion is salvaged for reuse.

Although the method has enjoyed widespread commercial success, there are inherent disadvantages associated with the use of the heated metal patterns. For example, the patterns are typically very expensive, and are fabricated with great difficulty due the need for compensating for thermal expansion and avoidance of pattern warpage at elevated temperatures.

Another method heretofore available for the manufacture of shell cores and molds involved the use of "wet" or liquid binders such as, for example, liquid furfuryl alcohol resin binders, in so-called "cold box" methods. In a cold box method heretofore available, for example, a relatively thin layer of sand coated with a liquid polymerizable binder is placed against the pattern. This is often done manually and the use of vibrators and the like, to increase interparticulate contact must be done carefully insofar as substantially vertical portions of the packed sand may tend to dislodge or separate.

In the latter methods the patterns which are used are provided with means for passing gas therethrough, and, typically, the entire mass of placed sand is cured by passing a resin-polymerizing catalyst in the gas phase therethrough to achieve curing of all the sand mixture.

The latter so-called cold box methods of making shell molds suffer the disadvantage of requiring hand packing or hand placement of the initially used binder-sand mixture with the resulting inconsistent and non-uniform sand-depth dimensions and oftentime uneven packing.

Illustrative of patents which have related to these areas include U.S. Pat. No. 3,008,205 to H. O. Blaies, Jr. "Shell Type Molds and Cores," U.S. Pat. No. 2,874,428 to J. L. V. Bonney, Jr. "Method of Hardening of Sand Cores and the Like", U.S. Pat. No. 3,145,438 to R. H. Kottke, et al., "Gas Cure of Organic Bonds for Sand and Abrasive Granules", U.S. Pat. No. 3,428,110 to J. Walker, et al., "Process for the Production of Foundry Cores and Molds" and U.S. Pat. No. 3,639,654 to J. Robins, for "Gaseous Halo-Sulfonic Acid Anhydride Catalysts for Curing Furfuryl Alcohol and Furan Resins."

It is an object of the present invention to provide a cold box method of making shell cores and molds, which method does not require the manual placement of a relatively thin layer of sand-binder mixture for complete curing thereof, and which method also provides automatically for the curing of the sand-binder mixture adjacent the pattern wall to a predetermined desired thickness.

SUMMARY OF THE INVENTION

This invention utilizes pressure ratio control with respect to before-gassing and after-gassing pressures for the purpose of controlling the depth of penetration of a gas catalyst into a shaped sand mass to achieve hardening or curing of only that portion of the shaped sand which is immediately adjacent a pattern or other shaping element. By controlling the pressure ratios, the volume of the residual interstitial inert gas trapped within the sand mass is controlled, and thus the penetration of the gas catalyst into the shaped sand mass is limited. While we do not want to be bound by any particular theories, it is our belief based on repeated observation that the inert gas (usually air) which initially resides in the interstitial space between the sand particles serves as a cushion or barrier preventing the rapid passage of the gas catalyst beyond the predetermined desired extent.

After gassing, and before the opening of the gassing chamber, the pressure within the chamber is preferably equalized to atmospheric pressure, e.g. by venting. In the event a sub-atmospheric post-gassing pressure is utilized the pressure within the internal "cushion" of the shaped sand mass must be increased to atmospheric pressure by venting directly into the interstitial voids, before opening the chamber to prevent the catalyst gas from penetrating further into the shaped sand mass when the pressure within the gassing chamber increases to atmospheric. When the post-gassing pressure is atmospheric or super-atmospheric the system is vented by way of the void space between the shaping element and the gassing chamber wall with no further penetration of the catalyst gas.

Referring now to the drawing:

FIG. 1 is a schematic elevational partially cross-sectional view of pattern apparatus for use in accordance with the present invention.

In FIG. 1 a pattern apparatus is generally indicated by the numeral 10. Pattern apparatus 10 consists of a thoroughly vented pattern 15, pattern-receiving evacuation receptable 20 and pattern cover 25. Pattern means 15 includes a body portion 16, having a plurality of vents 17, 17 therein, the body portion 16 having a radially extending flange 18 extending therefrom. Vents 17, 17 can be of the types conventionally used in pattern making, e.g. screened, or slotted, etc., and, consequently vents 17, 17 are not illustrated in detail because they are conventional. Receptacle 20 includes sidewalls 21 and bottom 20 which in composite with cover 25 provides gassing chamber 23. Cover 25 is equipped with vent means 30, which, in turn, is outfitted with a suitable valve means 35.

Receptacle 20 is also equipped with vent-vacuum means 40 which, in turn, is equipped with valve means 45. Also, receptacle 20 is equipped with catalyst-gassing means 50 having a plurality of conduits 51, 52, 53 entering receptacle 20 at various locations, catalyst-gassing means 50 being controlled by valve 55.

When pattern means 15 is placed in receptacle 20 with radially extending flanges 18 resting on the sidewalls 21 of receptacle 20 the void space 60 is provided between pattern means 15 and receptacle 20. Pressure reading means 65 extends to void space 60 to provide a reading of the gas pressure in void space 60.

PRACTICE OF THE INVENTION

The invention is further illustrated by the following Examples in which all of the amounts of ingredients are expressed in parts by weight unless otherwise indicated. All temperatures are expressed in degrees centrigrade, and all percentages are expressed in percent by weight of the component referred to based on the weight of the overall mixture referred to, unless otherwise indicated.

The first Example is intended to illustrate a typical mode of operation in accordance wih the present invention when a relatively noxious catalyst and a sub-atmospheric post-gassing pressure are employed. The second Example is intended to illustrate a typical mode of operation when a non-noxious catalyst and a super-atmospheric post-gassing pressure are utilized. In both instances, however, it will be appreciated that the thickness of the shell can be increased or decreased by increasing or decreasing, respectively, the pressure differential before and after gassing.

EXAMPLE 1

The equipment described heretofore is used and foundry sand having AFS fineness number in the range 80–90 is coated with 0.7 percent of a commercially available liquid resin identified as Farea 42, uniformly distributed on the sand. This resin is reported to comprise 42 percent furfuryl alcohol monomer, 58 percent by weight of a "UF-85" which is an equilibrium mixture of 60 parts formaldehyde, 25 parts of urea, and 15 parts of water. Farea 42 is reported to have about 9 percent water.

A mass of this sand mixture is charged into the body portion 16 of pattern 15, with an excess quantity of sand mixture being allowed to extend above the top of radially extending flanges 18. The pattern is vibrated to uniformly and thoroughly pack the sand mixture into body portion 16, and the excess is struck off in a conventional manner by drawing a screed (conventional in foundry practice, and therefore not shown) across the top of radially extending flanges 18. This leaves charge 70 of sand tightly packed within body portion 16. The packed pattern 15 is then placed in gassing chamber 23 with radially extending flanges 18 resting on sidewalls 21, forming a gas-tight seal therebetween. Cover means 25 is then placed over the packed pattern 15 resting on the top of radially extending flanges 18, thereby providing a gas-tight seal between the atmosphere and the interstitial void within sand mass 70.

Valves 35, 55 are then closed, and the pressure within gassing chamber 23 is then reduced to a pre-determined level, e.g. 100 mm hg. With valve 35 remaining closed, valve 45 is now closed and catalyst gassing valve 55 is open thereby introducing gaseous hydrogen chloride into void space 60 through conduits 51, 52, 53. Residual air within void space 60, as well as the residual interstitial gas within the packed sand mass 70 begins "retreating" ahead of the advancing catalyst gas. The result is that some of the air in void space 60 passes through vents 17 and into the interstitial spaces of sand mass 70. As the catalyst gas eventually reaches vents 17 and passes to within the interstitial spaces in sand mass 70, the extent to which the gaseous catalyst passes into the sand mass depends on the volume of the retreating "cushion" of inert residual gas. The final volume of the "cushion" of inert residual gas, in turn, depends on the pressure of the gas in void space 60 after gassing is completed. Thus, the extent to which the gas catalyst passes into the packed sand 70 also depends on the pressure after gassing. The relative thickness of the gas catalyst cured region can be illustrated, for example, by the dashed line 75 within sand mass 70 shown in FIG. 1. It is noted that a liquid binder containing substantial level of water serves as an extremely efficient scrubber of gaseous HCl, for example, and the resin is substantially instantaneously cured. In accordance with a preferred mode of operation of the apparatus and method of the present invention, valve 55 is closed as soon as the pressure reading means 65 reaches a desired level, e.g. 700 mm Hg.

Valve 35 on conduit vent means 30 is opened to permit gas pressure within the gassing chamber 23 to reach atmospheric pressure by introducing air through the inert gas "cushion" of the sand mass 70. When sub-atmospheric post-gassing pressures are used, it is important that this pressure be equalized first from within the sand mass 70 in order to arrest the further penetration of the catalyst gas into the sand mass when the pressure within the void space 60 increases to atmospheric pressure. Valve 45 is then opened to allow the gaseous HCl to be flushed out of the system permitting the atmospheric air to pass through the interstitial gas spaces within the sand mass 70 and the void space 60. Typically a conventional acid scrubber (not shown) is provided between the gassing chamber 23 and the pressure reducing means (not shown).

After removal of the cover means 25, and separation of the packed pattern 15 from the gassing chamber 23, the packed pattern means 15 is inverted elsewhere and the uncured sand is dumped therefrom for salvage and reuse. Thereafter the catalyst-hardened sand in the region 80 constitutes the shell core or mold and it is separated from the pattern 15. At this point the pattern 15 can be re-charged, and the apparatus means 10 reassembled as indicated above.

EXAMPLE 2

This Example is intended to illustrate the operation of the apparatus and method in accordance with the present invention when using a non-noxious catalyst, e.g. carbon dioxide, and a super-atmospheric post-gassing pressure. In principle, it is the same as the method outlined in Example 1, except that when post-gassing pressures which are super-atmospheric are utilized, it is necessary that the equalization of the pressure by venting occur by way of directly venting the chamber void space 60.

Foundry sand having 80–90 AFS fineness number is coated with a sodium silicate solution (aqueous) of the type described in detail in U.S. Pat. No. 2,874,428 to John L. V. Bonney, Jr. and the resulting binder-sand mixture is charged to the body of pattern 15 as described in Example 1. The resulting charged pattern 15 is vibrated to assure thorough and uniform packing of the sand-binder mixture and the excess sand-binder mixture is struck-off with a screed drawn along radially extending flanges 18.

The resulting packed pattern 15 is then placed within gassing chamber 23, with radially extending flanges 18 coming to rest on sidewalls 21 to form a gas-tight seal therebetween. Cover means 25 is then placed on top of radially extending flanges 18 and valves 35 and 55 are closed. A vacuum is drawn by opening valve 45 until a predetermined pressure $P_1$ is obtained as indicated by pressure reading means 65 and valve 45 is closed. Valve 55 is then opened to introduce gaseous carbon dioxide catalyst into void space 60 through conduits 51, 52, 53. As reported in connection with the preceding example, the air trapped in void space 60 as well as the interstitial air trapped within the packed sand mass 70 begins to retreat ahead of the advancing carbon dioxide gas catalyst and moves to the interstitial spaces of sand mass 70. Again, the extent to which the carbon dioxide gas catalyst advances into the interstitial spaces in said mass 70 depends on the final pressure in void space 60 because that pressure determines the volume of the inert residual gas which, again, serves as a "cushion" to arrest the rapid advance of the catalyst gas. The extent to which the carbon dioxide gas advances can be indicated, for example, by the dashed line 75 to provide the cured sand region 80 between the shaping element 15 and gas advance limit 75. When the post-gassing pressure reaches the required level, e.g. 800 mm Hg., the catalyst gassing means valve 55 is turned off, and the vent-vacuum means valve 45 is opened to allow the pressure within the void space 60 to be reduced to atmospheric pressure, e.g. 760 mm Hg. This reduction of pressure to atmospheric does not effect a greater penetration of the gas catalyst, and therefore does not affect the thickness of the cured shell. Cover means 25 is lifted and separated from the apparatus 10 and packed pattern 15 is removed and inverted elsewhere for dumping of the uncured sand for salvage and reuse. The cured sand region 80 then constitutes the shell core or mold which is separated from the pattern 15, and the pattern 15 is then charged, again, with the sand mix of the type referred to above, and the entire procedure repeated.

Unlike the preceding Example, the carbon dioxide catalyst in this Example is not flushed out of the void space 60, so that in this particular Example, valve 55 is closed when the pressure at pressure reading means 65 reaches the desired level, and valve 45 is opened to allow for easy removal of cover means 25. At this point the conditions are somewhat different from the conditions prevailing immediately upon the commencement of the first use of the equipment, insofar as the gas within the gassing chamber 23 includes a substantial level of carbon dioxide. Nonetheless, the operation of the apparatus is identical to that referred to above.

it is important to note that if the gas in the gassing canopy does contain a substantial level of carbon dioxide prior to the introduction of the gas catalyst, it may be necessary to adjust the pressure differential (post-gassing pressure minus pre-gassing pressure) to compensate for any early entry of the carbon dioxide from the interstitial spaces. Generally speaking, of course, the pressure differential employed is substantially less when the initial gas within the void space 60 contains a substantial level of the gas catalyst.

To summarize, when adjustment of the gas pressure of the gas within the void space 60 to atmospheric pressure requires an increase with respect to the post-gassing pressure $P_2$, the adjustment must be made by venting through the interstitial spaces in the sand mass 70. However when the adjustment of gas pressure of the gas within the void space 60 to atmospheric pressure requires a decrease with respect to post-gassing pressure $P_2$, the adjustment must be made by venting directly from the void space 60, e.g. through vent-vacuum conduit 40. When post-gassing pressure is atmospheric pressure, a further pressure adjustment or venting before cover 25 is removed, is unnecessary. Generally speaking, post-gassing pressure $P_2$ is that pressure prevailing whenever the gas catalyst has penetrated sand mass 70 to the deepest extent.

This invention is not limited to the use of any particular binders, or to any particular gaseous catalyst, and it is contemplated that it is applicable with any binder systems which are readily curable by any respective gas catalyst. Also, in the Examples referred to above substantially pure gas catalyst was referred to, and, in fact, either pure gas catalyst can be used or a gaseous mixture containing a catalyst, e.g. an air catalyst mixture, can be used for a more moderate modified curing rate.

Generally speaking, it is preferred that the relative sizes of gassing chamber 23 and pattern means 15, be such that a void space 60 be made as small as practical.

Although cover 25 is shown as a rigid element it can be alternatively, a flexible soft plastic sheet whenever $P_1$ and $P_2$ are sub-atmospheric pressures.

For a given system, with a specific volume of gas chamber and volume of sand-shaping element, the degree of penetration of the gas catalyst into the sand shaped mass can be controlled by controlling the ratio of the pressures of the system before and after gassing. For example, in one embodiment of the present invention, the initial vacuum may be pulled to 100–200 mm Hg., and during the catalysis the gas pressure may be permitted to raise to 500–700 mm Hg. If greater penetration is desired, an equilibrium post-gassing pressure closer to 760 at a super-atmospheric pressure may also be utilized.

In the event a sub-atmospheric pressure, e.g. a 500 mm Hg. gassing equilibrium pressure is utilized, the valve 35 can be opened to permit air to move through the sand shape thus sweeping some of the catalyst-containing gas back into the surrounding void space 60. It is preferred that the uncured sand be "dumped" out prior to removal of the cured sand article from the shaping element.

Also, the operation of this invention is not limited to the use of sub-atmospheric pressure ratios. The pressures can be super-atmospheric or atmospheric with super-atmospheric pressures, if desired. At the heart of this invention is the utilization of the residual pre-gassing inert gas as the internal cushion which limits the penetration of the advancing gas catalyst into the sand shape.

Although two catalyst resin systems were illustrated in the specific embodiments set forth above, the invention is not limited to specific catalyst resin systems. For example, the method can employ the well known amino-isocure catalyst-binder systems, as well as other systems.

I claim:

1. A method of manufacturing shell cores or molds comprising the steps:

(a) charging a sand mix to a pattern, said mix comprising sand having a uniform coating of binder dispersed thereon, said binder comprising a gas curable binder, said pattern having a sand receiving portion including a shaping surface, and an opening through which the sand is charged, said sand being charged into said pattern in sufficient quantity to provide a charged sand mass which fills the pattern to said opening said shaping surface including vent means for passing gas through said pattern;

(b) providing a gas barrier at said opening of the pattern, which barrier cuts off a communication of interstitial spaces in the charged sand in the area of said opening with any other gas space;

(c) placing the charged pattern in a gassing chamber, and sealing said charged pattern therein with respect to the atmospheric environment, said pattern and said gassing chamber being so dimensioned as to provide a void space between the pattern in the region of said shaping surface and the adjacent portions of the gassing chamber and, wherein the interstitial spaces in the charged sand are in direct pneumatic communication through said vent means with the void space in the gassing chamber;

(d) providing inert gas pressure $P_1$ in the gassing chamber;

(e) charging a gas catalyst to the chamber until the pressure in the void space is $P_2$, the difference between $P_1$ and $P_2$ being such that the extent of penetration of the catalyst into the charged sand mass is limited, and whereby a sand shell of desired thickness is cured.

2. The method of claim 1 in which said pattern includes radially extending flanges, and in which said sand is charged to said pattern in a sufficient quantity to provide an excess over that amount which would fill the pattern to provide sand extending above the flanges, and which method includes the step of packing the sand in the pattern; removing the excess sand from the pattern by scraping off the sand which extends above said radially extending flanges, and wherein said gas barrier is provided by placing a cover which rests on said radially extending flanges.

3. The method of claim 1 in which said binder is a furan-type binder, and in which said gas catalyst is a gaseous acidic catalyst.

4. The method of claim 1 in which said binder is a silicate type binder, and in which said gaseous catalyst is carbon dioxide.

5. The method of claim 1 in which binder is an isocure-type binder and said gaseous catalyst is an amine.

6. A method of manufacturing shell cores or molds comprising the steps:

(a) charging a sand mix to a pattern, said mix comprising sand having a uniform coating of binder dispersed thereon, said binder comprising a gas curable binder, said pattern having a sand receiving portion including a shaping surface, and an opening through which the sand is charged, said sand being charged into said pattern in sufficient quantity to provide a charged sand mass which fills the pattern to said opening said shaping surface including vent means for passing gas through said pattern;

(b) providing a gas barrier at said opening of the pattern, which barrier cuts off a communication of interstitial spaces in the charged sand in the area of said opening with any other gas space;

(c) placing the charged pattern in a gassing chamber, and sealing said charged pattern therein with respect to the atmospheric environment, said pattern and said gassing chamber being so dimensioned as to provide a void space between the pattern in the region of said shaping surface and the adjacent portions of the gassing chamber and, wherein the interstitial spaces in the charged sand are in direct pneumatic communication through said vent means with the void space in the gassing chamber;

(d) providing inert gas pressure $P_1$ in the gassing chamber;

(e) charging a gas catalyst to the chamber until the pressure in the void space is $P_2$, the difference between $P_1$ and $P_2$ being such that the extent of penetration of the catalyst into the charged sand mass is limited, and whereby a sand shell of desired thickness is cured;

(f) adjusting the pressure of the gas within the gassing chamber to atmospheric pressure, said adjustment being made by venting directly into the interstitial spaces in the charged sand when $P_2$ is below atmospheric pressure, said adjusting being made by venting directly into the gassing chamber void space between the pattern and the region of said shaping surface and the adjacent portions of the gassing chamber whenever the $P_2$ is super-atmospheric pressure; and (g) opening the gassing chamber and separating the shell core or mold from the pattern.

7. The method of claim 6 in which said pattern includes radially extending flanges, and in which said sand is charged to said pattern in a sufficient quantity to provide an excess over that amount which would fill the pattern to provide sand extending above the flanges, and which method includes the step of packing the sand in the pattern; removing the excess sand from the pattern by scraping off the sand which extends above said radially extending flanges, and wherein said gas barrier is provided by placing a cover which rests on said radially extending flanges.

8. The method of claim 6 in which said binder is a furan-type binder, and in which said gas catalyst is a gaseous acidic catalyst.

9. The method of claim 6 in which said binder is a silicate type binder, and in which said gaseous catalyst is carbon dioxide.

10. The method of claim 6 in which said binder is an isocure-type binder and said gaseous catalyst is an amine.

* * * * *